US008918935B2

(12) United States Patent
Gladney

(10) Patent No.: US 8,918,935 B2
(45) **Date of Patent: *Dec. 30, 2014**

(54) CHANNEL-CUT CUSHION SUPPORTS

(75) Inventor: Richard F. Gladney, Fairburn, GA (US)

(73) Assignee: Dreamwell, Ltd, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/548,081

(22) Filed: Jul. 12, 2012

(65) Prior Publication Data

US 2012/0297546 A1 Nov. 29, 2012

Related U.S. Application Data

(63) Continuation of application No. 12/283,909, filed on Sep. 16, 2008, now Pat. No. 8,250,689, which is a continuation of application No. 11/415,816, filed on May 1, 2006, now Pat. No. 7,424,763, which is a continuation of application No. 10/274,441, filed on Oct. 17, 2002, now Pat. No. 7,036,173.

(51) Int. Cl.
*A47C 27/00* (2006.01)
*A47C 27/20* (2006.01)

(52) U.S. Cl.
CPC ..... *A47C 27/20* (2013.01)
USPC ..... 5/730; 5/729

(58) Field of Classification Search
USPC ..... 5/655.7, 655.8, 655.9, 716, 718, 727, 5/728, 729, 730, 935, 936, 630, 632
See application file for complete search history.

(56) References Cited

U.S. PATENT DOCUMENTS

| | | | | | |
|---|---|---|---|---|---|
| 3,146,469 | A * | 9/1964 | Slade | 5/695 |
| 3,521,311 | A * | 7/1970 | Cohen | 5/727 |
| 3,732,586 | A * | 5/1973 | Frey | 5/718 |
| 3,846,857 | A * | 11/1974 | Weinstock | 5/727 |
| 4,522,447 | A * | 6/1985 | Snyder et al. | 297/452.27 |
| 4,628,557 | A * | 12/1986 | Murphy | 5/723 |
| 4,706,313 | A * | 11/1987 | Murphy | 5/722 |
| 4,768,253 | A * | 9/1988 | Boyd et al. | 5/718 |
| 4,947,500 | A * | 8/1990 | Seiler | 5/713 |
| 4,970,743 | A * | 11/1990 | Wride et al. | 5/679 |
| 5,025,519 | A * | 6/1991 | Spann et al. | 5/730 |
| 5,101,527 | A * | 4/1992 | Wadsworth et al. | 5/727 |
| 5,107,558 | A * | 4/1992 | Luck | 5/727 |
| 5,111,542 | A * | 5/1992 | Farley | 5/727 |
| 5,231,717 | A * | 8/1993 | Scott et al. | 5/727 |
| 5,564,140 | A * | 10/1996 | Shoenhair et al. | 5/400 |
| 5,756,022 | A * | 5/1998 | Siegel et al. | 264/46.7 |
| 5,953,779 | A | 9/1999 | Schwartz | |
| 5,960,496 | A * | 10/1999 | Boyd | 5/722 |
| 6,061,856 | A * | 5/2000 | Hoffmann | 5/728 |
| 6,115,861 | A * | 9/2000 | Reeder et al. | 5/727 |
| 6,192,538 | B1 * | 2/2001 | Fogel | 5/727 |
| 6,212,720 | B1 | 4/2001 | Antinori et al. | |
| 6,256,821 | B1 * | 7/2001 | Boyd | 5/722 |
| 6,269,504 | B1 * | 8/2001 | Romano et al. | 5/690 |

(Continued)

OTHER PUBLICATIONS

Notice of Allowance issued in U.S. Appl. No. 12/283,909, (now U.S. Patent 8,250,689), mailed May 9, 2012; 10 pages.

*Primary Examiner* — Frederick L Lagman
(74) *Attorney, Agent, or Firm* — Cantor Colburn LLP

(57) ABSTRACT

The support characteristics within a foam mattress body may be varied by inserting reinforcements into channels cut or otherwise formed within the foam.

16 Claims, 7 Drawing Sheets

(56) References Cited

U.S. PATENT DOCUMENTS

| | | | | |
|---|---|---|---|---|
| 6,523,198 | B1 * | 2/2003 | Temple | 5/604 |
| 6,574,814 | B2 | 6/2003 | Collard et al. | |
| 6,643,876 | B2 * | 11/2003 | Visser et al. | 5/720 |
| 6,739,008 | B1 * | 5/2004 | Kindrick | 5/730 |
| 6,813,791 | B2 * | 11/2004 | Mossbeck et al. | 5/720 |
| 6,952,850 | B2 * | 10/2005 | Visser et al. | 5/690 |
| 6,966,091 | B2 * | 11/2005 | Barber | 5/716 |
| 7,036,173 | B2 * | 5/2006 | Gladney | 5/730 |
| 7,185,369 | B2 * | 2/2007 | Thoone et al. | 726/30 |
| 7,424,763 | B2 * | 9/2008 | Gladney | 5/730 |
| 8,250,689 | B2 * | 8/2012 | Gladney | 5/729 |
| 2003/0019043 | A1 * | 1/2003 | Bryant et al. | 5/719 |
| 2007/0017033 | A1 * | 1/2007 | Antinori | 5/716 |

* cited by examiner

CHANNEL-CUT CUSHION SUPPORTS

CROSS REFERENCE TO RELATED APPLICATIONS

This application is a continuation of and claims the benefit of U.S. Pat. No. 8,250,689 filed on Sep. 16, 2008, which is a continuation of U.S. Pat. No. 7,424,763 filed on May 1, 2006, which is a continuation of U.S. Pat. No. 7,036,173 filed on Oct. 17, 2002, the contents of which are hereby incorporated herein by reference in its entirety.

BACKGROUND OF THE INVENTION

This invention relates to mattresses and more particularly to a mattress for maximizing the comfort of a person lying atop the mattress.

Mattresses made of homogenous foam are common. As a significant disadvantage, such material does not distribute localized forces well, resulting in more-than-desired deflection in regions of greater localized force or weight. An added disadvantage to such material is the uniformity of mechanical characteristics and deflection for a given load. Thus a typical foam mattress is not well adapted to the variations in weight and shape of a human body.

There remains a need for a mattress that varies in terms of deflection to a given applied force. More particularly, it is desirable to control variations in firmness at particular regions within a mattress, in order to accommodate different body types, as well as the subjective preferences of users.

SUMMARY

The support characteristics within a foam mattress body may be varied by inserting reinforcements of various types into channels cut or otherwise formed within the foam.

BRIEF DESCRIPTION OF THE DRAWINGS

The foregoing and other objects and advantages of the invention will be appreciated more fully from the following further description thereof, with reference to the accompanying drawings wherein.

DETAILED DESCRIPTION OF CERTAIN EMBODIMENT

To provide an overall understanding of the invention, certain illustrative embodiments will now be described, including a foam mattress with reinforcing pocket coils inserted into channels formed therein. It will be appreciated that the inventive concepts disclosed herein may have broad applications. The techniques may be used, for example, to provide support within seat cushions for automobiles or furniture, and may be realized with a wide variety of materials in lieu of the foam and pocket coils of the embodiments below. These and any other such modifications as would be clear to one of ordinary skill in the art are intended to fall within the scope of the systems described herein.

Like element numbers used in multiple figures herein refer to the same element, unless otherwise explicitly stated.

As used herein, the term "foam" shall mean any flexible and resilient open-celled elastiomeric material, synthetic or natural foams, rubber or plastic foams, blown or molded foams, and/or other homogenous or heterogeneous materials suitable for use with the mattresses described herein.

Figure 1:
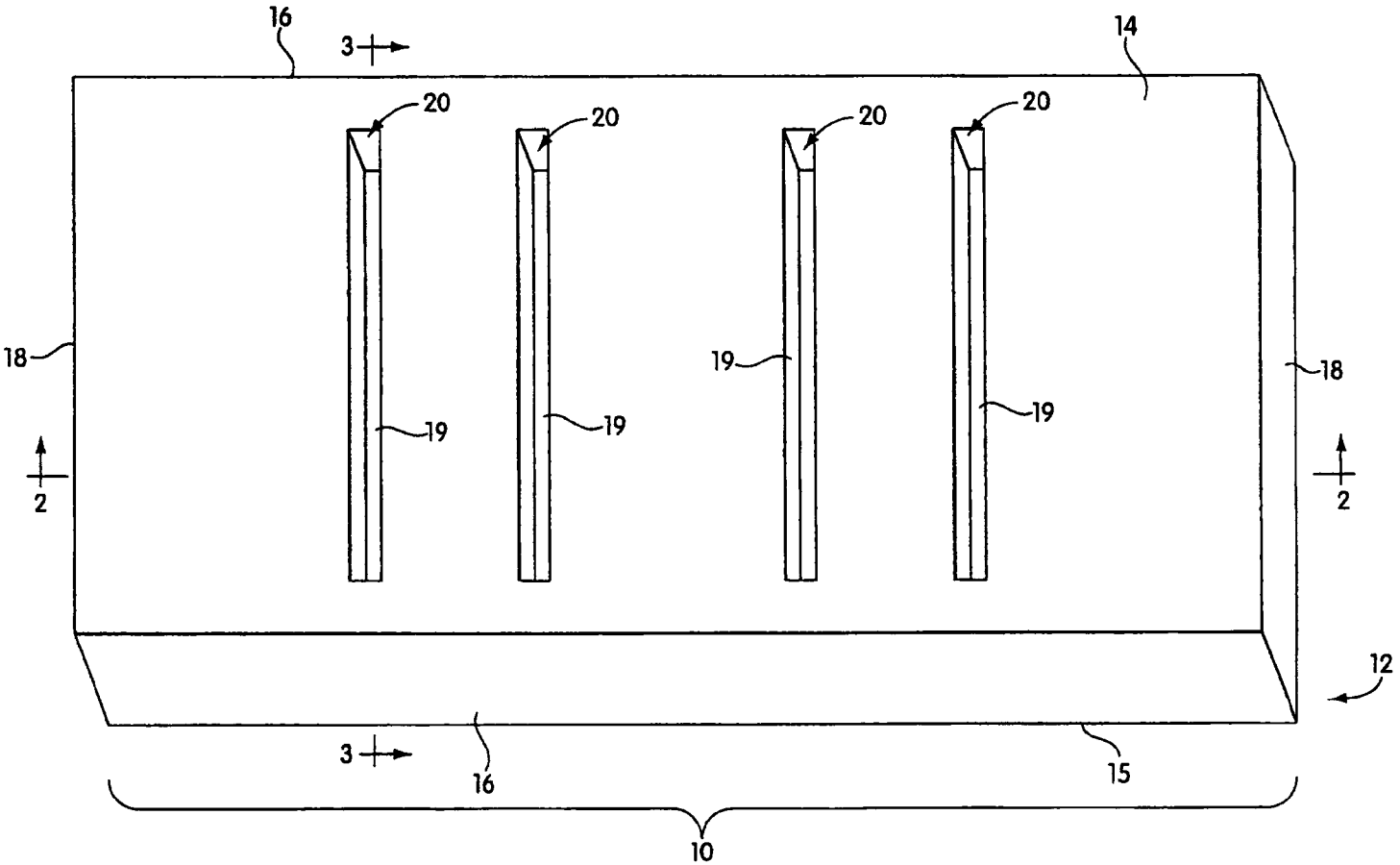
FIG. 1 is a top perspective of a mattress.

FIG. 1 is a top perspective of a mattress. In FIG. 1, there is illustrated a mattress 10 including a body 12 formed of foam and at least one insert 20 located within the body 12. The mattress in FIG. 1 has four such inserts 20, although more or less may be conveniently used.

The mattress 10 may be parallelepiped in shape, with the body 12 having a planar top surface 14, a planar bottom surface 15 substantially parallel and substantially equal in size to the top surface 14, two planar side surfaces 16 substantially parallel to each other, substantially equal to each other in size and perpendicular to the top surface 14 and a bottom surface 15, and two planar end surfaces 18 substantially parallel, substantially equal to each other in size and perpendicular to the top surface 14, the bottom surface 15 and each of the two end surfaces 18. The mattress 10 may be, for example, of the size and shape of any commercially-available mattress, which includes king (approximately 72-78 inch by 80-84 inch), queen (approximately 60-66 inch by 80 inch), full or double (approximately 54 inch by 75 inch), or twin (approximately 39 inch by 75-80 inch). While the embodiment in FIG. 1 has a body 12 of homogenous construction, the body 12 could be formed of a combination of various types of foam with different mechanical characteristics. For example, the body 12 could be composed of multiple layers of such material, varying in respective mechanical characteristics, progressing in layer upon layer from the top surface 14 to the bottom surface 15. In addition to such top-to-bottom layering (or in substitution therefor), the body 12 could be composed of multiple layers of such material, varying in respective mechanical characteristics, progressing in layer upon layer between both end surfaces 18, and/or between both side surfaces 16.

At least one channel 19 is disposed within the body 12. An insert 20 may be located within the channel 19. The embodiment in FIG. 1 has four such channels 19 and four corresponding inserts 20. Although the embodiment in FIG. 1 has the channels 19 in the top surface 14, it should be appreciated that the channels 19 and inserts 20 could be placed in any orientation or multiplicity within one, or more than one, of the surfaces 14, 15, 16, or 18 of the body 12, according to the desired location and degree of reinforcement. As in the embodiment in FIG. 1, the channels 19 and respective inserts 20 may be placed and distributed along the axis connecting the end surfaces 18 to provide for areas of different firmness or support characteristics along the body of one or more users lying on the mattress 10. The channels 19 and respective inserts 20 could also, or instead, be placed and distributed along the axis connecting the side surfaces 16 to provide for areas of different firmness or support characteristics between the two side surfaces 16 of the mattress 10, to provide multiple comfort zones, such as for multiple users of the mattress 10. The channel 19, and the insert 20, could be of any physical shape and orientation within the body 12, although the embodiment in FIG. 1 shows a linear shape parallel to the end surfaces 18.

One common measure of firmness is Indentation Load Deflection ("ILD") which is an objective measure of firmness for foams and other sleeping surfaces that is known to those skilled in the art. In general, the insert would provide a smaller ILD, i.e., greater firmness, than the surrounding foam of a mattress body.

Figure 2:
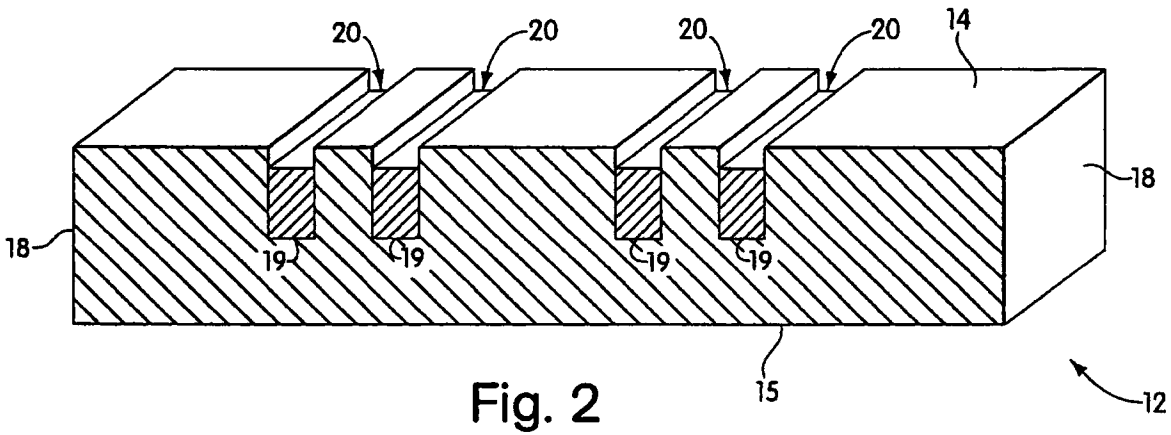
FIG. 2 is a cross sectional view taken on line 2-2 of FIG. 1.

FIG. 2 is a cross-sectional view of the mattress of FIG. 1. As depicted, the channel 19 may open onto and extend from one surface, the channel surface (in the embodiment shown in FIG. 2, the top surface 14), in a generally perpendicular direction from the channel surface (in FIG. 2, the top surface 14). The channel 19 extends into the body 12 for some distance from the channel surface, thus having a depth. If the channel 19 does not extend all the way through the body 12, the remaining foam beneath the channel may improve structural integrity and increase ease in manufacturing the mattress 10. The channel 19 of FIG. 2 is generally rectangular in cross-section, however other cross-sectional profiles may be suitably used with the mattresses described herein.

Figure 6:
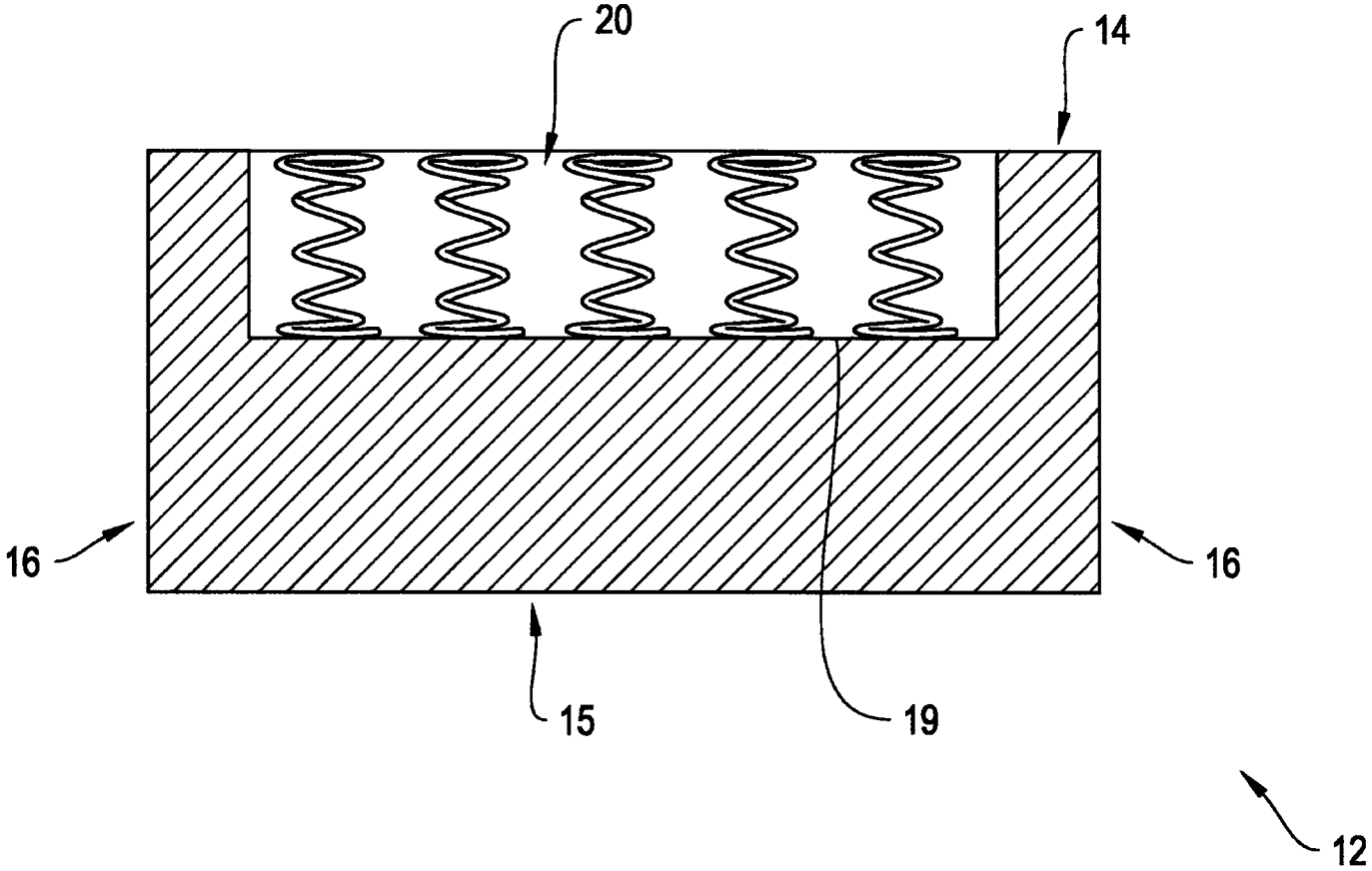
FIG. 6 is a cross sectional view taken on line 3-3 of FIG. 1, according to an illustrative embodiment of the invention.
Figure 7:
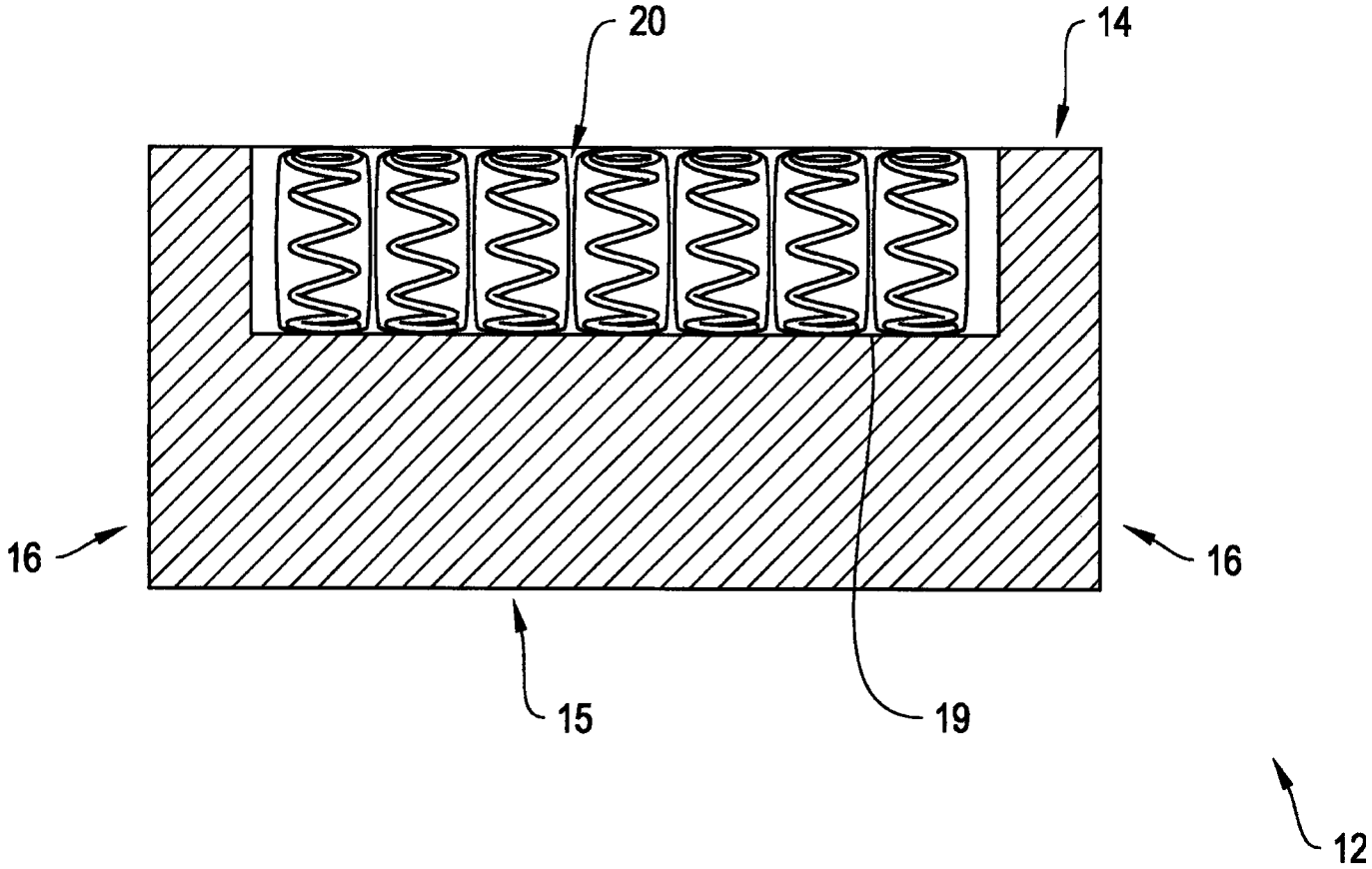
FIG. 7 is a cross sectional view taken on line 3-3 of FIG. 1, according to an illustrative embodiment of the invention.

An insert 20 is located within the channel 19. The insert 20 is of a size substantially equal to the channel 19. The insert 20 may be substantially flush with the channel surface (in FIG. 2, the top surface 14) or it may not entirely fill the channel 19. The insert 20 in the embodiment shown in FIG. 2 may be composed of material having mechanical characteristics different from the mechanical characteristics of the body 12. For example, a foam body 12 may have one or more non-foam inserts, such as loose or pocketed springs (shown in FIG. 6), a string of connected pocket springs (shown in FIG. 7), or any other material or construction suitable for adding support to a surface of the mattress 10.

In an embodiment, the channel 19 is shaped and sized to receive a string of pocket springs, with a row of springs placed in the channel 19 to reinforce the mattress 10. More than one row of connected pocket springs may be used, such as two or three adjacent rows, with the channel 19 sized accordingly. As another example, the foam body 12 may have one or more foam inserts with mechanical characteristics, such as firmness and density, different from the characteristics of the body 12. The insert 20 may itself be an aggregation of various materials having varying mechanical characteristics, such as individual spring coils in a rectangular foam strip, or held in place by wires or other support structures. If various materials are used in the insert 20, the materials therein could vary depending on depth from the channel surface, or along either axis of the channel 19 when viewed from the channel surface (in the embodiment of FIG. 2, could vary between the two side surfaces 16 and/or between the two end surfaces 18).

Figure 8:
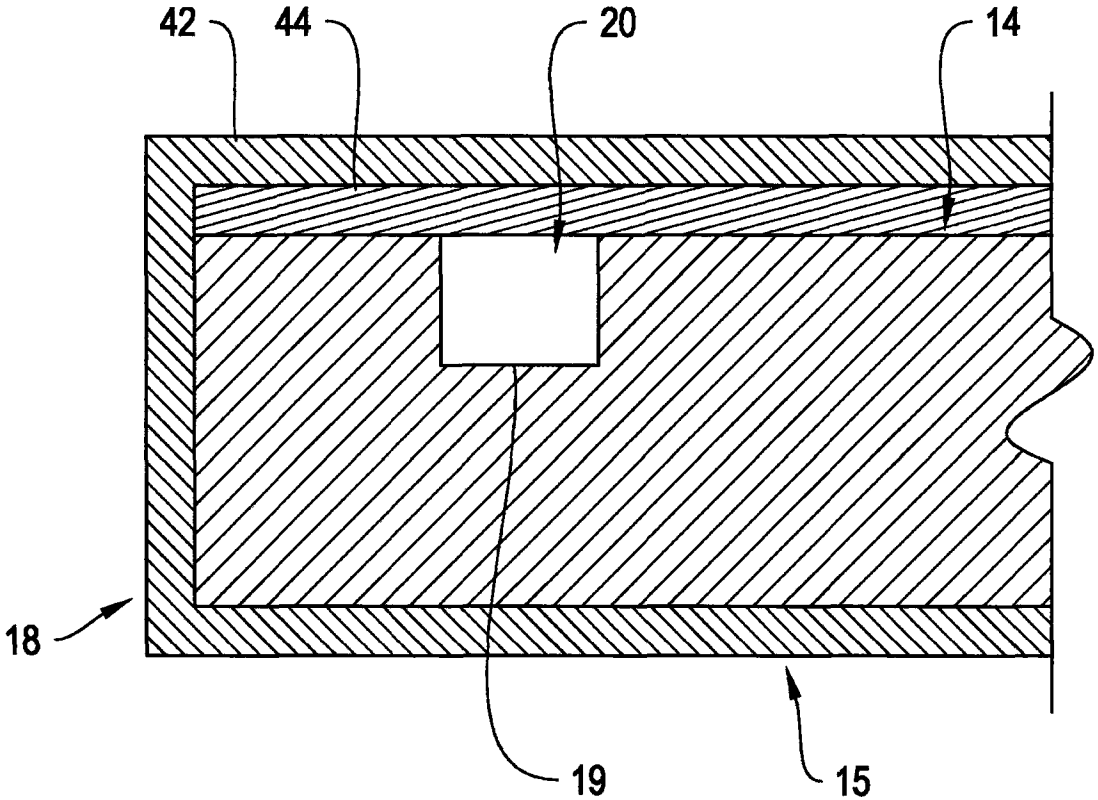
FIG. 8 is a cross sectional view taken on line 2-2 of FIG. 1, according to an illustrative embodiment of the invention.

The insert 20 may be permanently affixed within the channel 19 by conventional means such as by adhesive, melting due to applied heat, or frictional restraint. Alternately, the insert 20 may be merely placed within the channel 19 without attachment to the interior thereof, held in the channel 19 either by a customary cloth-type mattress cover 42 placed over the mattress 10 during manufacture, or by a layer of additional material 44 which might be added on top of the channel surface and cover the entire channel surface or that portion of the channel surface surrounding and including the channel 19 (shown in FIG. 8). Such added material on the channel surface could be foam (identical to, or differing in mechanical characteristics from, the material of which the body 12 is made), or any other material such as those commonly used as a mattress topper or cushion-top for mattresses, including batting, padding or quilting.

Figure 3:
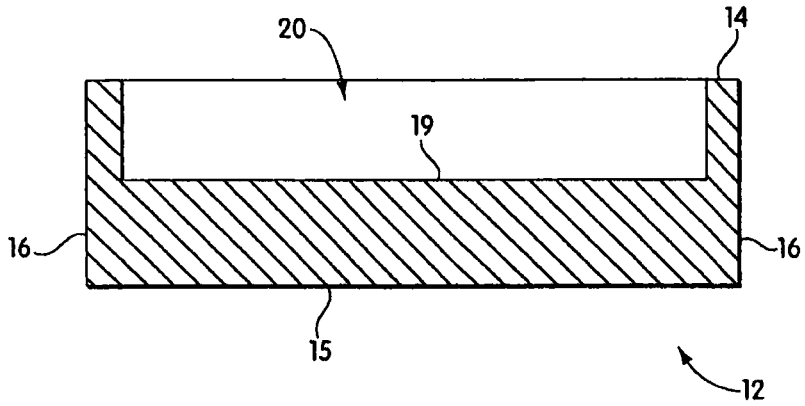
FIG. 3 is a cross sectional view taken on line 3-3 of FIG. 1.

FIG. 3 is a cross-sectional view of the mattress of FIG. 1. As shown in the embodiment set forth in FIG. 3, the channel 19 and the insert 20 do not extend to any of the surfaces other than the channel surface, in this embodiment the top surface 14.

Figure 4:
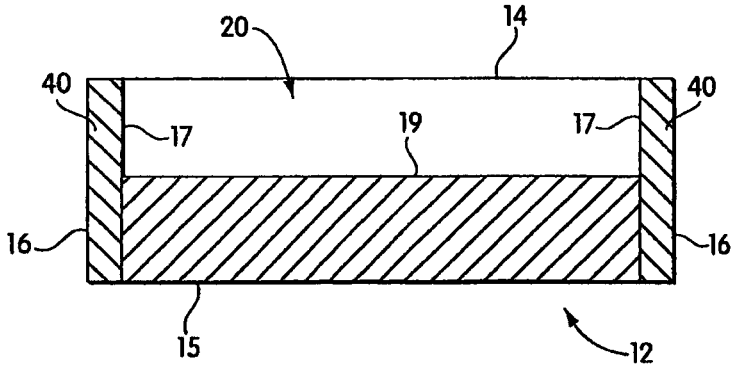
FIG. 4 is an alternative embodiment of the subject matter of FIG. 3.

FIG. 4 is an alternative embodiment of the subject matter of FIG. 3. As shown in FIG. 4, the channel 19 and insert 20 could extend to one or more of the other surfaces of the body 12, i.e., those at each end 17 of the channel 19. As depicted, these ends 17 are on the left-hand and right-hand sides of the channel 19, which are perpendicular to the top surface 14 of the channel 19. In such an embodiment, a layer 40 of material could be added to the ends 17 to which the channel 19 and insert 20 extend, to add structural integrity to the body 12 and provide means for further confinement and/or attachment of the insert 20 within the channel 19. The layer 40 could be composed of any material including foam (identical to, or differing in mechanical characteristics from, the material of which the body 12 is made), or any of the materials noted above. The layer 40 may also be formed from an adhesive-backed material such as tape. The layer 40 could be permanently affixed to the surfaces to which the channel 19 and insert 20 extend (in FIG. 4, the side surfaces 16) by conventional means such as by adhesive, melting due to applied heat, or frictional restraint. Alternately, the layer 40 may be merely placed abutting the surfaces to which the channel 19 and insert 20 extend without attachment thereto, held in place by a customary cloth-type mattress cover placed over the mattress 10 during manufacture or by a layer of additional material which might be added to cover and/or surround the layer 40 and/or that portion of the body 12 closest to the layer 40 to provide some added structural integrity between the layer 40 and the body 12. Such added material around the layer 40 and/or that portion of the body 12 closest to layer 40 could be made of foam (identical to, or differing in mechanical characteristics from, the material of which the body 12 is made), or any of the other materials noted above.

Figure 5:
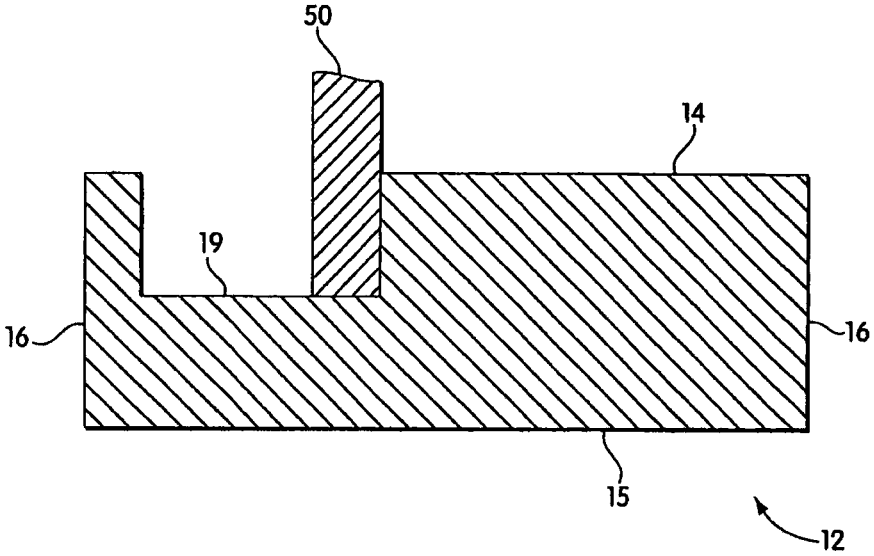
FIG. 5 depicts a technique for manufacturing the mattress of FIG. 1.

FIG. 5 depicts a technique for manufacturing the mattress of FIG. 1. As depicted in FIG. 5, the channel 19 may be cut by a cutting implement 50 inserted into the channel surface (in FIG. 5, the top surface 14). The cutting implement 50 may be any tool suitable for forming three-dimensional channels in foam, such as a foam router or other spinning or reciprocating tool. More generally, the cutting implement may employ a sharp edge, which may include teeth or serrations, or may employ heating wires or other applications of heat to melt the foam. Any other technique suitable for cutting and allowing the removal of the foam may similarly be employed. As depicted in FIG. 5, the cutting implement 50 is not as wide as the entire channel 19, and thus the entire channel 19 would be cut by directing the cutting implement across the area of the channel 19 in one or more passes. Similar affect may be achieved by repeated insertions and removals of the cutting implement 50 along the axis connecting the surfaces perpendicular to the channel surface (in FIG. 5, the top surface 14), in FIG. 5, the side surfaces 16. Alternately, the cutting implement 50 could be of the desired length of the entire channel 19 such that the cutting implement 50 would only need to be inserted into and removed from the channel surface once to cut the entire channel 19. Likewise, depending on the desired width of the channel 19 and the width of the cutting implement 50, single or multiple cuts could be made to create the final channel 19 with the desired width.

Although not depicted in FIG. 5, it will be appreciated that the channel 19 may be cut through the body 12, such as from a top surface to a bottom surface, or may be cut so that it extends to an end 17 of the channel 19, such as from a top surface to one or both of the side surfaces. Any resulting exposed end of the channel 19 created during such a cutting operation could be covered by an extra layer of material, including foam or any other material noted above.

A mattress 10 as described herein may be produced by positioning the body 12 in a way conducive to the production steps, cutting with a cutting implement at least one channel within at least one of the surfaces of the body, and inserting an insert within such channel.

A location of the channel(s) may be selected by identifying regions within a surface of the mattress where additional support is desired. This may depend, for example, on the shape or weight distribution of a user, or, where a number of mattresses are to be made, a typical or representative user.

Channels may be formed in the mattress by cutting. The cutting may be performed by inserting the cutting implement into one surface of the body (the channel surface). The channel may open onto only the channel surface or also one or more of the surfaces perpendicular to the channel surface. Alternately, or in addition, the cutting may be done by inserting the cutting implement into the surface of the body perpendicular to the channel surface. The cutting implement may be smaller than the desired channel (or the decision may be made to cut less than the entire channel at one time with a large cutting implement), thus requiring repeatedly inserting and removing of the cutting implement to cut the entire channel. Alternately, the cutting implement could be of the desired length of the entire channel, allowing inserting of the cutting implement only once to cut the entire channel. Likewise, depending on the desired width of the channel and the width of the cutting implement, cutting single or multiple times may be required to achieve the desired width.

If it is desired or necessary for the channel to extend fully to, and thus open onto, at least one of the surfaces perpendicular to the channel surface, or if such method of cutting is otherwise preferred, the channel may be cut by inserting the cutting implement into a surface of the body perpendicular to the channel surface. As discussed above in the context of channel length, depending on the width and depth of the cutting implement and the desired width and depth of the channel, cutting the channel may entail repeatedly inserting and removing the cutting implement. After such cutting, the exposed channel opening on the surface(s) perpendicular to the channel surface may be covered by placing an extra layer of material thereon, as discussed above herein.

As an alternative to cutting instruments, one or more channels 19 may be formed in the body 12 of a mattress 10 by molding the channels 19 into the foam of the body 12 as the body 12 itself is molded. Additionally, or instead, the body 12 may be formed of a number of rectangular foam sections assembled so that the assembled body 12 includes the channels 19.

Once a channel has been formed in the foam, an insert, such as any of the inserts described above, may be placed into the channel. The insert may be affixed to the channel using adhesives, heat, or friction or any other physical restraint suitable for maintaining the insert's position within the mattress. These steps may be repeated for one or more channels and inserts.

Upon completion of the above steps, the mattress with inserts may be finished with any suitable padding and/or upholstery layers.

While certain embodiments of the invention have been shown and described, persons skilled in this art will appreciate changes and modifications which may be made without departing from the spirit of the invention. Therefore, the inventor does not intend to be limited except by the scope of the following claims.

The invention claimed is:

1. A mattress comprising:

a multilayered foam body having a planar top surface, the foam body including a plurality of channels extending from the planar top surface into at least one of the foam layers defining the multilayered foam body; and at least one insert having planar top and bottom surfaces affixed to each one of the plurality of channels, each insert reinforcing the foam body, wherein each of the plurality of channel has a physical shape configured to receive one or more of the inserts, wherein the inserts comprise foam and have a different mechanical property than the foam body, and wherein the insert does not entirely fill the channel.

2. The mattress of claim 1, wherein the insert comprises an aggregation of different materials having different mechanical properties.

3. The mattress of claim 2, wherein the different materials extend along a longitudinal axis of the channel when viewed from a surface of the channel.

4. The mattress of claim 2, wherein the different materials extend along a vertical axis of the channel when viewed from a surface of the channel.

5. The mattress of claim 2, wherein the different materials extend along both a vertical axis and a longitudinal axis of the channel when viewed from a surface of the channel.

6. The mattress of claim 1, wherein the inserts are affixed within the plurality of channels with an adhesive.

7. The mattress of claim 1, wherein the inserts are affixed within the plurality of channels by applied heat.

8. The mattress of claim 1, wherein the inserts are affixed within the plurality of channels by frictional restraint.

9. The mattress of claim 1, wherein the mechanical property is firmness.

10. A method of manufacturing a mattress comprising:

providing a plurality of rectangular foam pieces to form a body of foam shaped and sized for use as a mattress;

locating a region of the body where increased support is desired;

assembling the rectangular foam pieces to form the body having a channel in the region; and affixing at least one insert having planar top and bottom surfaces into the channel, wherein the channel has a physical shape configured to receive the at least one insert, the insert having a different mechanical property than the body of the foam, and wherein the insert does not entirely fill the channel.

11. The method of manufacturing a mattress of claim 10, wherein the insert comprises an aggregation of different materials having different mechanical properties.

12. The method of manufacturing a mattress of claim 10, wherein the inserts comprise a string of pocket springs, foam, individual coils in a foam strip or combinations thereof.

13. The method of manufacturing a mattress of claim 10, wherein affixing at least one insert into the channel comprises applying adhesive, heat, or frictional restraint.

14. The method of manufacturing a mattress of claim 10, wherein more than one insert is affixed into a selected one of the channels, wherein each of the more than one insert has a different mechanical property and extend along a longitudinal axis of the channel when viewed from a surface of the channel.

15. The method of manufacturing a mattress of claim 10, wherein more than one insert is affixed into a selected one of the channels, wherein each of the more than one insert has a different mechanical property and extend along a vertical axis of the channel when viewed from a surface of the channel.

16. The method of manufacturing a mattress of claim 10, wherein more than one insert is affixed into a selected one of the channels, wherein each of the more than one insert has a different mechanical property and extend along both a vertical axis and a longitudinal axis of the channel when viewed from a surface of the channel.

* * * * *